United States Patent [19]

Comstock et al.

[11] Patent Number: 4,717,428

[45] Date of Patent: Jan. 5, 1988

[54] ANNEALING OF ZIRCONIUM BASED ARTICLES BY INDUCTION HEATING

[75] Inventors: Robert J. Comstock, Penn Township, Westmoreland County; William A. Jacobsen, Burrell Township, Indiana County; Francis Cellier; George P. Sabol, both of Murrysville, all of Pa.

[73] Assignee: Westinghouse Electric Corp., Pittsburgh, Pa.

[21] Appl. No.: 762,094

[22] Filed: Aug. 2, 1985

[51] Int. Cl.[4] ..... C21D 1/00

[52] U.S. Cl. ..... 148/11.5 F; 148/133

[58] Field of Search ..... 148/133, 11.5 F, 421; 219/10.51, 8.5, 10.41

[56] References Cited

U.S. PATENT DOCUMENTS

| | | | |
|---|---|---|---|
| 3,487,675 | 1/1970 | Edstrom et al. | 72/370 |
| 3,865,635 | 2/1975 | Hofvenstam et al. | 148/11.5 F |
| 4,090,386 | 5/1978 | Naylor et al. | 72/208 |
| 4,233,834 | 11/1980 | Matinlassi | 72/208 |
| 4,238,251 | 10/1980 | Williams et al. | 148/133 |
| 4,279,667 | 7/1981 | Anthony et al. | 148/32 |
| 4,294,631 | 10/1981 | Anthony et al. | 148/331 |
| 4,360,389 | 11/1982 | Urquhart | 148/11.5 F |
| 4,372,817 | 2/1983 | Armijo et al. | 376/417 |
| 4,390,497 | 6/1983 | Rosenbaum et al. | 376/414 |
| 4,450,016 | 5/1984 | Vesterlund et al. | 148/11.5 F |
| 4,450,020 | 5/1984 | Vesterlund | 148/11.5 F |
| 4,521,259 | 6/1985 | Eucken | 148/20.3 |

FOREIGN PATENT DOCUMENTS

| | | | |
|---|---|---|---|
| 85553 | 8/1983 | European Pat. Off. | 148/133 |
| 0085552A2 | 8/1983 | European Pat. Off. . | |
| 2607141 | 9/1976 | Fed. Rep. of Germany . | |
| 2747054 | 4/1978 | Fed. Rep. of Germany . | |
| 2302348 | 9/1976 | France | 148/133 |
| 2509510 | 1/1983 | France . | |
| 71193 | 2/1983 | Japan | 148/11.5 F |
| 1537930 | 1/1979 | United Kingdom . | |
| 2086945 | 5/1982 | United Kingdom . | |
| 2118573 | 11/1983 | United Kingdom . | |

OTHER PUBLICATIONS

Steinberg et al. "Analytical Approaches and Experimental Vertification to Describe the Influence of Cold Work and Heat Treatment on the Mechanical Properties of Zircaloy Cladding Tubes", ASTM STP 824 (1984) pp. 106–122.

Garzarolli et al. "Influence of Final Annealing on Mechanical Properties of Zircaloy before and after Irradiation" Transaction of the 6th International Conference on Structural Mechanics in Reactory Technology, North-Holland Publishing, (1981).

Hunt et al. "Recrystallization of Zircaloy-4 During Transient Heating," Journal of Nuclear Materials, 92 (1980), p. 184.

Kass, "The Development of the Zircaloys", ASTM STP 368 (1964), pp. 3–27.

ASTM B350-80.

WAPD-TM-869 dated 11/79.

WAPD-TM-1289 dated 1/81.

Rose et al. "Quality Costs of Zircaloy Cladding Tubes", Nuclear Fuel Performance, British Nuclear Energy Society (1973), pp. 78.1–78.4.

Anderson et al., "Beta Quenching of Zircaloy Cladding Tubes in Intermediate or Final Size", ASTM STP 754 (1982), pp. 75–95.

*Primary Examiner*—Christopher W. Brody

*Attorney, Agent, or Firm*—R. A. Stoltz

[57] ABSTRACT

Processes for the rapid alpha annealing of zirconium based articles are described. These processes utilize induction heating to rapidly heat a worked zirconium based article to an elevated temperature after which it is then cooled. Time at the selected elevated temperature is less than about 1 second, and preferably essentially zero. Stress relieving of cold pilgered Zircaloy may be performed by induction heating to a temperature between about 540° and about 650° C. Partial recrystallization annealing of cold pilgered Zircaloy may be performed by induction heating to a temperature between about 650° and about 760° C. Full alpha recrystallization annealing of cold pilgered Zircaloy may be performed by induction heating to a temperature between about 760° and about 900° C.

7 Claims, 3 Drawing Figures

ANNEALING OF ZIRCONIUM BASED ARTICLES BY INDUCTION HEATING

BACKGROUND OF THE INVENTION

The present invention is concerned with the annealing of cold worked reactive metal based tubes by induction heating. It is especially concerned with the induction alpha annealing of cold pilgered zirconium base tubing.

Zircaloy-2 and Zircaloy-4 are commercial alloys, whose main usage is in water reactors such as boiling water (BWR), pressurized water (PWR) and heavy water (HWR) nuclear reactors. These alloys were selected based on their nuclear properties, mechanical properties and high temperature aqueous corrosion resistance.

The history of the development of Zircaloy-2 and 4 is summarized in: Stanley, Kass "The Development of the Zircaloys" published in ASTM Special Technical Publication No. 368 (1964) pp. 3–27, and Rickover et al. "History of the Development of Zirconium Alloys for use in Nuclear Reactors", NR: D: 1975. Also of interest with respect to Zircaloy development are U.S. Pat. Nos. 2,772,964; 3,097,094 and 3,148,055.

The commercial reactor grade Zircaloy-2 alloy is an alloy of zirconium comprising about 1.2 to 1.7 weight percent tin, about 0.007 to 0.20 weight percent iron, about 0.05 to 0.15 weight percent chromium and about 0.03 to 0.08 weight percent nickel. The commercial reactor grade Zircaloy-4 alloy is an alloy of zirconium comprising 1.2 to 1.7 weight percent tin, about 0.18 to 0.24 weight percent iron, and about 0.07 to 0.13 weight percent chromium. Most reactor grade chemistry specifications for Zircaloy-2 and 4 conform essentially with the requirements published in ASTM B350-80 (for alloy UNS No. R60802 and R60804, respectively). In addition to these requirements the oxygen content for these alloys is typically required to be between 900 and 1600 ppm, but more typically is about 1200±200 ppm for fuel cladding applications. Variations of these alloys are also sometimes used. These variations include a low oxygen content alloy where high ductility is needed (e.g. thin strip for grid applications). Zircaloy-2 and 4 alloys having small but finite additions of silicon and/or carbon are also commercially utilized.

It has been a common practice to manufacture Zircaloy (i.e. Zircaloy-2 and 4) cladding tubes by a fabrication process involving: hot working an ingot to an intermediate size billet or log; beta solution treating the billet; machining a hollow billet; high temperature alpha extruding the hollow billet to a hollow cylindrical extrusion; and then reducing the extrusion to substantially final size cladding through a number of cold pilger reduction passes (typically 2 to 5 passes with about 50 to about 85% reduction in area per pass), having an alpha recrystallization anneal prior to each pass. The cold worked, substantially final size cladding is then final alpha annealed. This final anneal may be a stress relief anneal, partial recrystallization anneal or full recrystallization anneal. The type of final anneal provided is selected based on the designer's specification for the mechanical properties of the fuel cladding. Examples of these processes are described in detail in WAPD-TM-869 dated 11/79 and WAPD-TM-1289 dated 1/81. Some of the characteristics of conventionally fabricated Zircaloy fuel cladding tubes are described in Rose et al. "Quality Costs of Zircaloy Cladding Tubes" (Nuclear Fuel Performance published by the British Nuclear Energy Society (1973), pp. 78.1–78.4).

In the foregoing conventional methods of tubing fabrication the alpha recrystallization anneals performed between cold pilger passes and the final alpha anneal have been typically performed in large vacuum furnaces in which a large lot of intermediate or final size tubing could be annealed together. Typically the temperatures employed for these bath vacuum anneals of cold pilgered Zircaloy tubing have been as follows: about 450° to about 500° C. for stress relief annealing without significant recrystallization; about 500° C. to about 530° C. for partial recrystallization annealing; and about 530° C. to about 760° C. (however, on occasion alpha, full recrystallization anneals as high as about 790° C. have been performed) for full alpha recrystallization annealing. These temperatures may vary somewhat with the degree of cold work and the exact composition of the Zircaloy being treated. During the foregoing batch vacuum alpha anneals it is typically desired that the entire furnace load be at the selected temperatures for about one to about 4 hours, or more, after which the annealed tubes are vacuum or argon cooled.

The nature of the foregoing batch vacuum alpha anneals creates a problem which has not been adequately addressed by the prior art. This problem relates to the poor heat transfer conditions inherent in these batch vacuum annealing procedures which may cause the outer tubes in a large bundle (e.g. containing about 600 final size fuel cladding tubes) to reach the selected annealing temperature within about an hour or two, while tubes located in the center of the bundle, after 7 to 10 hours (at a time when the anneal should be complete and cooling begun) have either not reached temperature, are just reaching temperature, or have been at temperature for half an hour or less. These differences in the acutal annealing cycle that individual tubes within a lot experience can create a significant variation in the tube-to-tube properties of the resulting fuel cladding tubes. This variablity in properties is most significant for tubes receiving a stress relief anneal or a partial recrysallization anneal, and is expected to be reduced by using a full recrystallization anneal. Where the fuel cladding design requires the properties of a stress relieved or partially recrystallized microstructure, a full recrystallization final anneal is not a viable option. In these cases extending the vacuum annealing cycle is one option that has been proposed, but is expensive in that it adds time and energy to an already long heat treatment which may already be taking on the order of 16 hours from the start of heating of the tube load to the completion of cooling.

Additional examples of the conventional Zircaloy tubing fabrication techniques, as well as variations thereon, are described in the following documents: "Properties of Zircaloy-4 Tubing" WAPD-TM-585; Edstrom et al. U.S. Pat. No. 3,487,675; Matinlassi U.S. Pat. No. 4,233,834; Naylor U.S. Pat. No. 4,090,386; Hofvenstam et al. U.S. Pat. No. 3,865,635; Anderson et al. "Beta Quenching or Zircaloy Cladding Tubes in Intermediate or Final Size," *Zirconium in the Nuclear Industry: Fifth Conference,* ASTM STP754 (1982) pp. 75–95; McDonald et al. U.S. patent application Ser. No. 571,122 (a continuation of Ser. No. 343,787, filed Jan. 29, 1982 now abandoned and assigned to the Westinghouse Electric Corporation); Sabol et al. U.S. patent application Ser. No. 571,123 (a continuation of Ser. No.

343,788, filed Jan. 29, 1982, now abandoned and assigned to the Westinghouse Electric Corporation); Armijo et al. U.S. Pat. No. 4,372,817; Rosenbaum et al. U.S. Pat. No. 4,390,497; Vesterlund et al. U.S. Pat. No. 4,450,016; Vesterlund U.S. Pat. No. 4,450,020; and Vesterlund French Patent Application Publication No. 2,509,510 published Jan. 14, 1983.

SUMMARY OF THE INVENTION

The present inventors have discovered new alpha annealing processes which provide a significant improvement over the prior art annealing practices described above in terms of both annealing time and uniformity of treatment. The processes according to the present invention utilize induction heating to rapidly heat a worked zirconium base article to an elevated temperature after which it is then cooled. The elevated temperature utilized is selected to provide either a stress relieved structure, a partially recrystallized structure, or a fully alpha recrystallized structure. Time at the elevated temperatures selected is less than 1 second, and most preferably essentially zero hold time.

In accordance with one embodiment of the present invention stress relief, partial recrystallization or full recrystallization annealing of 50 to 85% cold pilgered Zircaloy may be accomplished by scanning the as pilgered tube with an elongated induction coil to rapidly heat the tube to a maximum temperature, $T_1$, at a heat up rate, a. Upon exiting the coil, cooling of the tube is immediately begun at a cooling rate, b, to a temperature of at least about $T_1-75°$ C. $T_1$ and $|b|$ are controlled to satisfy one of the following conditions:

A. Stress Relief Annealing $$\sqrt{\frac{.01}{.99}} > \frac{153.1K}{|b|}[\log_e(Ao/A)]^2 e^{-41842/T1}$$

or

B. Partial Recrystallization Annealing $$\sqrt{\frac{.01}{.99}} < \frac{153.1K}{|b|}[\log_e(Ao/A)]^2 e^{-41842/T1} \approx \sqrt{\frac{.95}{.05}}$$

or

C. Full Recrystallization Annealing $$\sqrt{\frac{.95}{.05}} < \frac{153.1K}{|b|}[\log_e(Ao/A)]e^{-41842/T1}$$

For the above conditions:

Ao/A = ratio of cross sectional areas of tube before and after cold pilgering;

$K=5\times10^{20}$ hour$^{-1}$;

$|b|$ = cooling rate in °K./hour;

$T_1$ = maximum temperature in °K.;

and $a >> |b|$.

The rapid heat up rates provided by induction heating in accordance with the present invention are in excess of 167° C. (300° F.) per second, and preferably greater than about 444° C. (800° F.) per second. Most preferably, these heat up rates are in excess of 1667° C. (3000° F.) per second.

The cooling rates in accordance with the present invention are preferably between about 2° C. (5° F.) to 556° C. (1000° F.) per second, and more preferably 2° C. (5° F.) to 278° C. (500° F.) per second. Most preferably cooling rates are between 2° C. (5° F.) to 56° C. (100° F.) per second. Preferably the rate of heating is at least 10 times the rate of cooling.

It is believed that about 70 to 85% cold pilgered Zircaloy tubing may be preferably stress relieved in accordance with the present invention by induction heating to a temperaure between about 540° and about 650° C. with an essentially zero hold time, followed by cooling at a rate of about 10° C. (20° F.) to 17° C. (30° F.) per second.

It is believed that about 70 to 85% cold pilgered Zircaloy tubing may be preferably partially recrystallized in accordance with the present invention by induction heating to a temperature between about 650° and about 760° C. with an essentially zero hold time followed by cooling at a rate of about 10° C. (20° F.) to 17° C. (30° F.) per second.

It is believed that about 70 to 85% cold pilgered Zircaloy tubing may be preferably fully alpha recrystallized in accordance with the present invention by induction heating to a temperature between about 760° and about 900° C., with an essentially zero hold time followed by cooling at a rate of about 10° C. (20° F.) to 17° C. (30° F.) per second.

These and other aspects of the present invention will become more clear upon careful review of the following drawings and detailed specification.

DETAILED DESCRIPTION OF THE INVENTION

Figure 1:
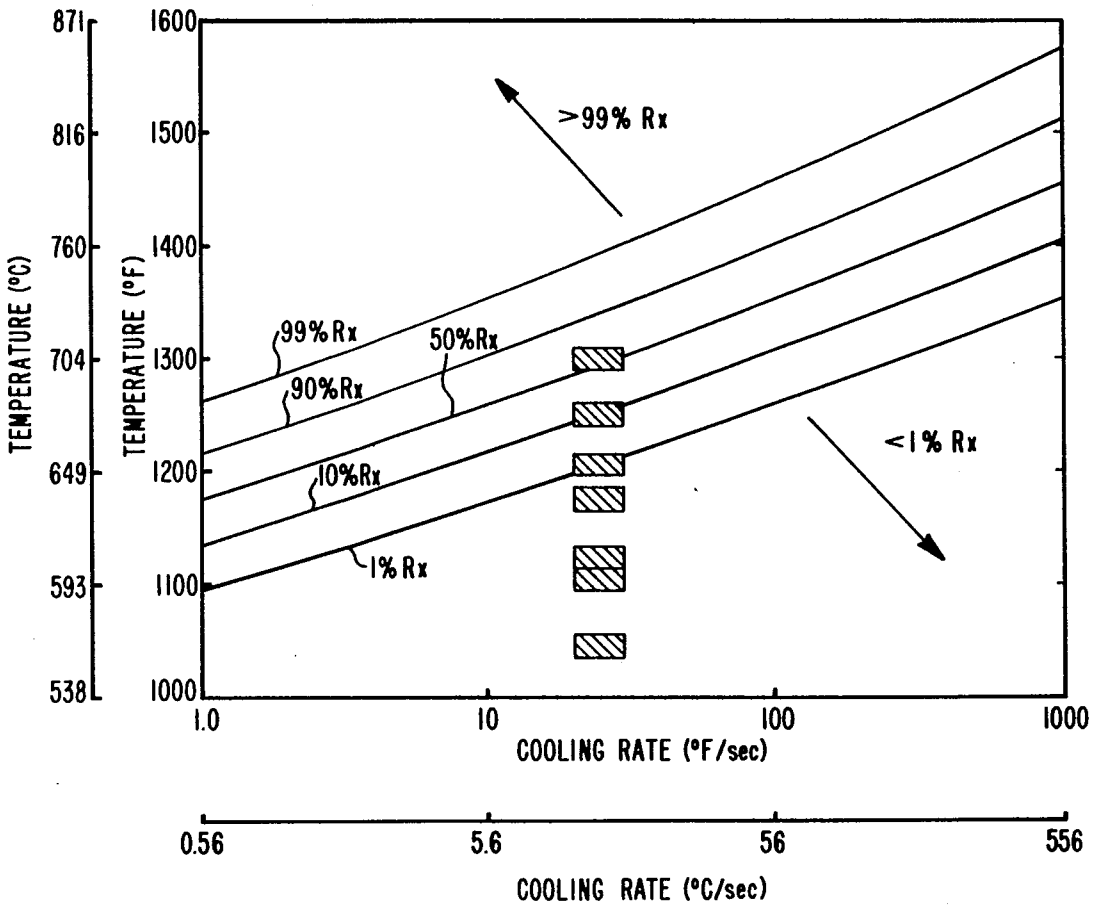
FIG. 1 is a graph of the resulting microstructure as a function of both induction annealing temperature and cooling rate in accordance with the theory of the present invention as applied to one embodiment of the present invention.

In accordance with the present invention we have found that conventional alpha vacuum anneals of cold worked Zircaloy articles can be replaced by rapid induction anneals. In induction annealing of Zircaloy tubing, we believe that each tube can be cycled through an essentially identical temperature history by controlling the tube temperature as it exits the coil and controlling the subsequent cooling rate. Such a process should result in uniform heat treatments within a tube, from tube-to-tube, and from lot-to-lot as the temperature history of every tube can be individually controlled and monitored. The annealing process times for our temperature cycles are on the order of seconds as compared to hours for batch vacuum furnace anneals. As a result, higher temperatures than those currently used in batch vacuum furnace anneals are required to compensate for the shorter times. We have found that our short time high temperature induction anneals do not have a deleterious effect on the properties of the resulting Zircaloy tubing.

Preferably all heating and high temperature cooling are performed in a protective atmosphere (e.g. Ar, He or $N_2$) in order to minimize surface contamination. In accordance with our invention, each tube is scanned by an induction heating coil so that each point on the tube progressively (i.e. in turn) sees a time/temperature cycle in which it is first rapidly heated to a temperature between about 540° and 900° C. and preferably 590° to 870° C. The heat up rate is in excess of 167° C. (300° F.)/second, more preferably at least 444° C. (800° F.)/second. Most preferably the material is heated to temperature at a rate in excess of 1667° C. (3000° F.)/second. These high heat up rates are preferred in that they allow rapid tube translational speeds through the coil (e.g. greater than or equal to about 600 inches/-minute) while minimizing the coil length required.

Upon exiting the coil the material is at its maximum temperature and cooling preferably begins immediately. The cooling rate is preferably between about 2° C. (5° F.) and about 556° C. (1000° F.) second, more preferably between 2° C. (5° F.) and 278° C. (500° F.) second, and most preferably between 2° C. (5° F.) and 56° C. (100° F.) second. After the material has cooled below about 75° C., and preferably below about 150° C. of its maximum temperature, the material may be more rapidly cooled since the effect of time at temperature at these relatively lower temperatures does not significantly add to the degree of stress relief or recrystallization. As will become apparent subsequently, the relatively slow cooling rates contemplated (compared to the heat up rate) allow the maximum temperature required for a particular annealing cycle to be reduced. The time/temperature cycles in accordance with the present invention have been selected to avoid alpha to beta transformation. The short time periods at high temperature allow alpha anneals to be performed within the temperature range (about 810° to about 900° C.) normally associated with alpha and beta structures, without however producing observable (by optical metallography) alpha to beta transformation.

Before proceeding further in the description of the present invention the following terms are defined for the purposes of this description as follows:

1. Alpha annealing means any annealing process which results in a stress relieved, partially recrystallized, or fully recrystallized structure which does not produce any signs of beta phase transformation when examined by optical metallography.

2. Stress relief annealing refers to any alpha annealing process which results in less than about 1% by volume (or area) substantially equiaxed recrystallized grains.

3. Recrystallization annealing refers to any alpha annealing process which results in 1 to 100% by volume (or area) substantially equiaxed recrystallized grains.

4. Partial recrystallization annealing refers to any alpha annealing process which results in 1 to 95% by volume (or area) substantially equiaxed recrystallized grains.

5. Full recrystallization annealing refers to any alpha annealing process which results in greater than about 95% by volume (or area) substantially equiaxed recrystallized grains.

While not wishing to be bound by theory it is believed that the understanding of, use of, and the advantageous results obtained from, the present invention can be furthered by the following theory.

The effect of an alpha annealing treatment on the microstructure of cold worked Zircaloy is dependent on both annealing time, t, and annealing temperature, T. In order to describe an annealing cycle by a single parameter, Garzarolli et al. ("Influence of Final Annealing on Mechanical Properties of Zircaloy Before and After Irradiation," Transactions of the 6th International Conference on Structural Mechanics in Reactor Technology, Vol. C 2/1, Paris 1981) proposed the use of a normalized annealing time, A, as defined below:

$$A = te^{-Q/RT} \tag{1}$$

where t = time (hours),

Q = activation energy (cal. mole$^{-1}$),

R = universal gas constant (1.987 cal. mole$^{-1}$ °K.$^{-1}$), and

T = temperature (°K.).

The above parameter is useful in characterizing the effect of an annealing cycle on a particular process such as recovery or recrystallization provided the appropriate activation energy for that process is known. Experimental values of Q/R for recrystallization of Zircaloy range from 40000° K. to 41550° K. while a different activation energy would be appropriate for describing stress relief of Zircaloy.

A more general form of A where time at temperature is comparable to the time required for heating and cooling the sample is:

$$A = \int_{t_i}^{t_f} e^{-Q/RT} dt \tag{2}$$

where T is a function of time, t, and $t_i$ and $t_f$ are the beginning and ending times of the annealing cycle. Assuming a constant heating rate, a, from $T_0$ to $T_1$, a hold time, t, at temperature, $T_1$, and a constant cooling rate, b, from $T_1$ to $T_2$, A becomes:

$$A = \frac{1}{a} \int_{T_0}^{T_1} e^{-Q/RT} dT + te^{-Q/RT_1} + \frac{1}{b} \int_{T_1}^{T_2} e^{-Q/RT} dT \tag{3}$$

The integrals in equation (3) can be rewritten as:

$$\int_{x_0}^{x_1} e^{-Q/RT} dT = I(x_1) - I(x_0) \tag{4a}$$

where $$I(x) = \int_0^x e^{-Q/RT} dT \tag{4b}$$

I(x) was evaluated numerically for a range of x from 750° K. (890° F.) to 1200° K. (1700° F.). A temperature increment of 0.1° K. was used for the numerical integration and Q/R was taken to be 40000° K., a suitable value for recrystallization of Zircaloy. (Experimental values of Q/R for recovery processes in Zircaloy were not available.) Results of the numerical integration are summarized in Table I.

To put the numerical integrations in Table I in a more usable form, the results were fitted to an exponential equation. The resulting empirical equation for approximating the integral in equation (4) is given below:

$$J(x) = 153.1e^{-41842/x} \tag{5}$$

TABLE I

| Temperature (°K.) | Evaluation of Equations 4b and 5 I(T) (°K.) (Eq. 4b) | J(T) (°K.) (Eq. 5) | J(T)/I(T) |
|---|---|---|---|
| 750 | $9.33 \times 10^{-23}$ | $9.04 \times 10^{-23}$ | 0.969 |
| 800 | $2.97 \times 10^{-21}$ | $2.95 \times 10^{-21}$ | 0.995 |
| 850 | $6.33 \times 10^{-20}$ | $6.41 \times 10^{-20}$ | 1.012 |
| 900 | $9.68 \times 10^{-19}$ | $9.87 \times 10^{-19}$ | 1.020 |
| 950 | $1.12 \times 10^{-17}$ | $1.14 \times 10^{-17}$ | 1.022 |
| 1000 | $1.01 \times 10^{-16}$ | $1.03 \times 10^{-16}$ | 1.018 |
| 1050 | $7.48 \times 10^{-16}$ | $7.56 \times 10^{-16}$ | 1.011 |
| 1100 | $4.63 \times 10^{-15}$ | $4.63 \times 10^{-15}$ | 1.000 |
| 1150 | $2.45 \times 10^{-14}$ | $2.42 \times 10^{-14}$ | 0.986 |
| 1200 | $1.14 \times 10^{-13}$ | $1.10 \times 10^{-13}$ | 0.970 |

J(x) was evaluated over the temperature range of 750° K. (890° F. ) to 1200° K. (1700° F.) (see Table I). Maximum deviation from I(x) over that temperature range was only 3% indicating that J(x) was a suitable expression for the evaluation of equation (4b). The purpose of deriving J(x) was to provide a usable expression for calculating the contribution to the annealing parameter resulting from linear heating or cooling of the sample.

Use of equations (4) and (5) permits the normalized annealing time for recrystallization, $A_{Rx}$, to be written as:

$$A_{Rx} = \frac{J(T_1) - J(T_0)}{a} + t\,e^{-40000/T1} + \frac{J(T_2) - J(T_1)}{b} \quad (6)$$

The first term is the contribution to $A_{Rx}$ during heating, the second term is the contribution to $A_{Rx}$ during the hold period, and the third term is the contribution during cooling. For $T_0 << T_1$ and $T_2 << T_1$, the contribution of $J(T_0)$ and $J(T_2)$ becomes insignificant so that $A_{Rx}$ can be rewritten as:

$$A_{Rx} = \frac{J(T_1)}{a} + t\,e^{-40000/T} - \frac{J(T_1)}{b} \quad (7)$$

It should be noted that the cooling rate, b, is negative so that the overall contribution to A during cooling $(-J(T_1)/b)$ will be positive.

For the induction annealing cycles used in the following examples according to the present invention, there was rapid heating to temperature, zero hold time, and relatively slow cooling. In effect, the microstructural changes occurred predominantly during cooling of the tube. The normalized annealing time, $A_{Rx}$, for describing the above induction annealing cycle was calculated using equation (7). The heating rate was assumed to be nominally $1.7 \times 10^6$° K./hour (850° F./second), the hold time, t, was set equal to 0.0, and the cooling rate was assumed to range from $-6.0 \times 10^4$° to $-4.0 \times 10^4$° K./hour (−30° to −20° F./sec). (Estimates of the heating rate were based on the temperature rise of the tube, the coil length, and the translational speed.) The calculated values of $A_{Rx}$ for the seven annealing temperatures for which mechanical property and metallographic data were obtained are summarized in Table II.

TABLE II

| Temperature (°F.) | Normalized Annealing Time for Recrystallization of Zircaloy Cladding by Induction Heating* $A_{Rx}$ (Eq. 7) (Hours) | $A_{Rx}$ (Eq. 8) (Hours) |
|---|---|---|
| 1045 | $4.82\text{–}7.15 \times 10^{-25}$ | $4.66\text{–}6.99 \times 10^{-25}$ |

TABLE II-continued

| Temperature (°F.) | Normalized Annealing Time for Recrystallization of Zircaloy Cladding by Induction Heating* $A_{Rx}$ (Eq. 7) (Hours) | $A_{Rx}$ (Eq. 8) (Hours) |
|---|---|---|
| 1105 | $3.29\text{–}4.88 \times 10^{-24}$ | $3.18\text{–}4.77 \times 10^{-24}$ |
| 1125 | $6.04\text{–}8.95 \times 10^{-24}$ | $5.83\text{–}8.75 \times 10^{-24}$ |
| 1175 | $2.58\text{–}3.83 \times 10^{-23}$ | $2.50\text{–}3.74 \times 10^{-23}$ |
| 1205 | $5.93\text{–}8.79 \times 10^{-23}$ | $5.73\text{–}8.59 \times 10^{-23}$ |
| 1250 | $1.95\text{–}2.89 \times 10^{-22}$ | $1.88\text{–}2.83 \times 10^{-22}$ |
| 1300 | $6.82\text{–}10.11 \times 10^{-21}$ | $6.59\text{–}9.88 \times 10^{-21}$ |

A suitable approximation for $A_{Rx}$ for the induction heating cycles under evaluation is the following:

$$A_{Rx} = \frac{J(T_1)}{|b|} = \frac{153.1}{|b|}\,e^{-41842/T1} \quad (8)$$

The above approximation is valid for annealing cycles in which the heating rate is much larger than the cooling rate, i.e., $|a| >> |b|$. Equation (8) was evaluated for the above seven annealing temperatures and for b ranging from $-6.0 \times 10^4$° to $-4.0 \times 10^4$° K./hour (−30° to −20° F./sec). The results are tabulated in Table II. Comparison with the values of $A_{Rx}$ calculated using equation (7) indicates that equation (8) is a reasonable approximation.

The motivation for calculating a normalized annealing time for induction annealing cycle is twofold. First, it reduces characterization of the induction anneal from two parameters (cooling rate and annealing temperature) to a single parameter. This permits the influence of different cooling rates and annealing temperatures to be quantified in terms of a single parameter so that different annealing cycles can be directly compared.

The second reason for calculating A is that it permits comparison between short duration, high temperature induction anneals and more conventional furnace anneals. Probably a more fundamental question to be answered, however, is whether such a parameter is in fact suitable for characterizing heat treatments which are distinctly different. For example, furnace anneals consist of several hours at temperature while induction anneals in accordance with our invention are transient in nature in which microstructural changes occur predominantly during cooling. The ability to describe such divergent annealing cycles with a single parameter would provide a measure of confidence that recovery or recrystallization of Zircaloy is dependent upon A and not upon the annealing path.

As previously noted, experimental values of Q/R for recovery of Zircaloy were not available for calculating an annealing parameter characteristic of stress relieving ($A_{SRA}$). However, an expression for such a parameter could be developed following the derivation used to obtain $A_{Rx}$ once Q/R for recovery becomes available.

While $A_{SRA}$ is clearly the more important parameter for characterizing stress relief anneals, $A_{Rx}$ does define a lower limit, $A_{Rx}$*, above which recrystallization begins. In this sense, $A_{Rx}$* defines a boundary between stress relief annealing and the onset of recrystallization. Therefore, the annealing temperature and cooling rate used for stress relief annealing must result in an annealing parameter less than $A_{Rx}$*.

Steinberg et al. ("Analytical Approaches and Experimental Verification to Describe the Influence of Cold Work and Heat Treatment on the Mechanical Properties of Zircaloy Cladding Tubes," Zirconium in the Nuclear Industry: Sixth International Symposium, ASTM STP824, Franklin et al. Eds., American Society for Testing and Materials, 1984, pp. 106–122) derived an expression for the fraction of material recrystallized, R, as a function of annealing parameter, $A_{Rx}$, and cold work, $\phi$. Their expression is given below:

$$\sqrt{\frac{R}{1-R}} = k\,\phi^2 A_{Rx} \tag{9}$$

where:

$A_{Rx}$=normalized annealing time in hours, $k=5.0\times10^{20}$ hour$^{-1}$, $\phi=\log_e(l/l_0)=\log_e(A_0/A)$, $l_0, A_0$=length and tube cross section prior to cold reduction, and $l, A$=length and tube cross section after cold reduction.

The data used in the derivation of equation (9) were obtained from furnace annealed Zircaloy-4 tubing with cold work ranging from 0.51 to 1.44. Substituting equation (8) for $A_{Rx}$, contour lines for recrystallization fractions ranging from 0.01 to 0.99 were calculated as a function of annealing temperature and cooling rate. The value of 100 was calculated for the final cold reduction of our (0.374 inch OD×0.23 inch wall) tubing and found to be 1.70. The contours are plotted in FIG. 1.

The upper left of the figure defines annealing temperatures and cooling rates where complete recrystallization (i.e., >99% Rx) can be expected while the lower right identifies annealing temperatures and cooling rates where essentially no recrystallization occurs (i.e., <1% Rx). The band in the center of the figure identifies parameters suitable for recrystallization annealing (1–99% Rx). Also included in FIG. 1 are rectangles identifying annealing temperatures (±10° F.) and cooling rates (about 20° to 30° F./second) characteristic of seven induction annealing treatments for which mechanical property and metallographic data are reported in Table VI (~160 inches/minute).

The significance of FIG. 1 is that it predicts induction annealing parameters (annealing temperature and cooling rate) for recrystallization based upon experimental data obtained on furnace annealed material. The contours were calculated on the premise that the normalized annealing time, $A_{Rx}$, was a unique parameter independent of annealing cycle. Experimental confirmation of the uniqueness of $A_{Rx}$ was provided by the induction annealing treatments identified in FIG. 1. Partial recrystallization was observed in samples annealed at 677° C. (1250° F.) and 705° C. (1300° F.) while samples annealed at 652° C. (1205° F.) or less showed no evidence of recrystallization as determined by optical microscopy or room temperature tensile properties. A more sensitive technique, such as TEM, (transmission electron microscopy) may be required to resolve the suggestion that annealing temperatures of ~650° C. (~1200° F.) result in ~1% recrystallization. In spite of that uncertainty, the above observations are judged to be in particularly good agreement with the predicted recrystallization behavior of induction annealed Zircaloy.

The good correlation between observation and prediction indicates that a single parameter is suitable for describing the recrystallization behavior of Zircaloy cladding for both furnace and induction annealing. The implication of that statement is that a single activation energy (Q/R=40000° K. or Q=79480 cal/mole) can be used to describe recrystallization over a wide range of annealing temperatures which suggests that the recrystallization mechanism for both furnace and induction annealing is the same.

Figure 2:
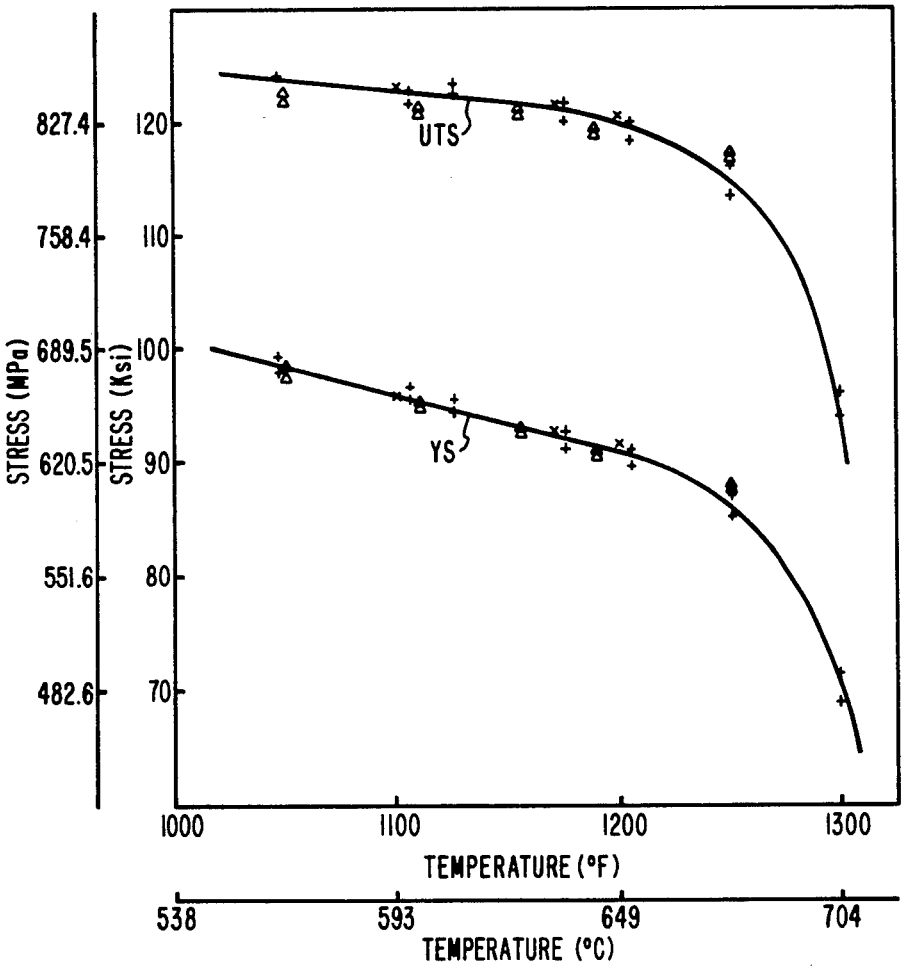
FIG. 2 is a graph of UTS (ultimate tensile strength) and YS (yield strength) as a function of induction annealing temperature for three different induction scanning speeds x, + and Δ in accordance with the present invention.

Even though an expression for $A_{SRA}$ was not available, it is clear from the derivation for $A_{Rx}$ that the important parameters to be controlled during induction annealing, whether for stress relief or recrystallization, are the temperature of the tube as it exits the coil and the subsequent cooling rate (see equation (8)). Interestingly enough, neither of these parameters are directly dependent upon production rate. This means that the physical properties are expected to be the same for tubes induction annealed at 160 inches/minute or at 600 inches/minute, for example, provided annealing temperature and cooling rate remain the same. Evidence of the independence between properties and production rate is provided in FIG. 2 where YS (yield strength) and UTS (ultimate tensile strength) are plotted as a function of annealing temperature for tubes annealed at 75 to 80 inches/minute (+), 134 to 168 inches/minute (x), and 530 to 660 inches/minute (Δ). Agreement between the three sets of data is good.

The above results indicate that the production rate does not significantly impact the metallurgical changes which occur during induction heating. The following examples clearly demonstrate that induction treatments in accordance with our invention can be used to stress relieve, partially recrystallize and fully recrystallize Zircaloy tubing. These examples are provided to further clarify the present invention, and are intended to be purely exemplary of the invention.

Induction annealing of final size (0.374 inch outside diameter (OD)×0.023 inch wall) Zircaloy-4 tubing was performed using an RF (radio frequency) generator, having a maximum power rating of 25 kW. Frequencies in the RF range are suitable for through wall heating of thin walled Zircaloy tubing. As shown, schematically in FIG. 3, induction annealing was performed in an argon atmosphere by translating and rotating a Zircaloy tube 1 through a multi-turn coil 5.

Temperature was monitored as the tube 1 exited the coil 5 by an IRCON G Series pyrometer 10 with a temperature range from 427° C. (800° F.) to 871° C. (1600° F.). The emissivity was set by heating a tube to 705° C. (1300° F.) as measured by an IRCON R Series two-color pyrometer and adjusting the emissivity setting to obtain a 705° C. (1300° F.) reading on the G Series pyrometer. The resulting emissivity value ranged from 0.30 to 0.35. These pyrometers are supplied by IRCON, Inc., a subsidiary of Square D Company, located in Niles, Ill.

The induction coil 5 was mounted on the inside of an aluminum box 15 which served as an inert atmosphere chamber. A guide tube 20 with a teflon insert was located on the entrance side of the coil 5 to keep the tube 1 aligned relative to the coil. A second tube 22 is provided after the argon purge tube 24 and the water-cooled cooling tube 26. Additional tube support was provided by two three-jaw adjustable chucks 30 which were located on the entrance and exit side of the box. The jaws were 1.75-inch diameter rollers which permitted the tube to freely rotate through the chuck while still providing intermediate tube support. The rollers on the entrance side were teflon while the rollers on the exit side were a high temperature epoxy. Near the entrance side of the box additional support is provided to the tube 1 by stationary sets of three freely rotatable rollers 32 and sets of two freely rotatable rollers further away from the box (not shown).

The water-cooled cooling tube 26, located on the exit side of the coil, assists in cooling the Zircaloy tube before discharge of the tube to air. (Note: water does not contact the Zircaloy.) An argon purge of the inside of the cooling tube as well as in the inert atmosphere chamber was maintained to minimize oxidation of the OD surface of the tube. However, it was not possible to adequately cool the tubes with the available system as a thin oxide film formed on the OD surface of the tubes as they exited the box. The oxide was subsequently removed by a combination of pickling and polishing of the OD surface. An argon purge of the inside of the Zircaloy tube was used to prevent oxide formation of the ID surface.

Tube translation and rotation were provided by two variable speed DC motors, 35 and 40, located on the exit side of the annealing chamber. Both motors were mounted on an aluminum plate 45 which moved along a track 50 as driven by the translation motor 35 and gear system. The second variable speed DC motor 40 has a chuck 42 which engages the tube 1 and provides tube rotations up to 2500 RPM. Mounted on chain 52, also driven by motor 35, were pairs of freely rotatable rollers 60 which supported tube 1 and moved along with the tube 1.

Preliminary induction heat treatments of as-pilgered Zircaloy-4 cladding were performed at nominal translational speeds of 80 inches/minute. Induction heating parameters are summarized in Table III. Room temperature tensile properties were measured on tube sections annealed between 593° C. (1100° F.) and 649° C. (1200° F.) as described in Table IV.

After appropriate modifications to the tube handling system and coil design, a second round of induction anneals were performed at nominal translational speeds of 134 to 168 inches/minute. The induction heating parameters are summarized in Table III. Induction anneals were typically performed by keeping power fixed and adjusting tube speed to obtain the desired annealing temperature.

Twenty four, full length (155 inches long) as-pilgered tubes were obtained. Limitations of our experimental tube handling system permitted only a portion of the tube (~88 inches) to be induction annealed. Induction annealing temperatures ranged from 521° C. (970° F.) to 732° C. (1350° F.); temperature control along the length of the tubes was typically ±10° F. A summary of the annealing temperature, translational speed, and rotational speed for each of the tubes is provided in Table V.

Tubes were cooled by radiation losses and forced convection as provided by an argon purge of the cooling tube. Estimates of the cooling rate were obtained in the following way. After heating a tube to temperature and turning off the power to the coil, the heated portion of the tube was repositioned beneath the pyrometer and temperature was monitored as a function of time. Cooling rates measured in this way ranged from 20° to 30° F./second. No effort was made to control (or measure) cooling rate during the induction anneals other than maintenance of a fixed argon flow and cooling tube geometry.

Following induction annealing, the tubes received final finishing operations and post-anneal UT inspection. The OD surface oxide was not completely removed by pickling. However, the surface was visually acceptable on five tubes which were subsequently abraded and polished.

Room temperature tensile properties were measured on samples cut from seven tubes annealed from 563° C. (1045° F.) to 705° C. (1300° F.). Three samples from each of the tubes were tensile tested to assess variability along the length of a given tube as well as to establish tensile properties as a function of annealing temperature. The three samples represent the beginning, middle and end of the annealed tube length. Tubes were tested in the as-pickled condition. Metallographic samples representative of the seven annealing temperatures were prepared to correlate microstructure with corresponding tensile properties. These results are presented in Table VI. The ingot chemistries of the three Zircaloy-4 lots processed are provided in Table VII.

TABLE III

Coil Design and Frequency for Induction Annealing (0.374 inch OD × 0.023 inch wall tubing)

| | | | |
|---|---|---|---|
| Nominal Range of Production Rates (inches/minute) | 75–80 | 134–168 | ~530–660 |
| Copper Tubing OD (inches) | ¼ | 5/16 | 5/16 |
| Coil Length (inches) | 1.7 | 3.25 | 3.2 |
| Coil ID (inches) | 1.2 | 1.125 | 0.75 |
| No. of Coil Turns | 4 | 8 | 8 |
| Frequency (kHz) | 325 | 375 | 385 |

TABLE IV

Induction Heat Treatments
Zircaloy-4 Tubing Lot 4377

| Tube | Nominal Temperature °C. | Nominal Temperature (°F.) | Speed (inches/minute) | RPM |
|---|---|---|---|---|
| 3 | 593 | (1100) | 80.0 | 900 |
| 4 | 632 | (1170) | 76.5 | 900 |
| 2 | 649 | (1200) | 75.0 | 900 |

TABLE V

Induction Heat Treatments
Zircaloy-4 Tubing Lot M5595

| Tube | Nominal Temperature °C. | Nominal Temperature (°F.) | Speed (inches/minute) | RPM |
|---|---|---|---|---|
| 23 | 521 | (970) | 168.4 | 600 |
| 22 | 538 | (1000) | 148.6 | 600 |
| *24 | 563 | (1045) | 151.9 | 600 |
| 7 | 568 | (1055) | 170.3 | 600 |
| 14 | 588 | (1090) | 165.2 | 600–400 |
| *9 | 596 | (1105) | 164.6 | 600 |
| 15 | 599 | (1110) | 163.4 | 250 |
| 5 | 604 | (1120) | 161.0 | 600 |
| *6 | 607 | (1125) | 161.0 | 600 |
| 2 | 618 | (1145) | 156.7 | 600 |
| 10 | 621 | (1150) | 157.6 | 600 |
| 18 | 621 | (1150) | 160.8 | 600 |
| 25 | 627 | (1160) | 160.0 | 600 |
| 17 | 632 | (1170) | 157.5 | 600 |
| *16 | 635 | (1175) | 155.7 | 400 |
| 20 | 646 | (1195) | 153.2 | 900 |
| 11 | 649 | (1200) | 150.1 | 600 |
| *4 | 652 | (1205) | 148.6 | 600 |
| 19 | 666 | (1230) | 150.4 | 600 |
| *8 | 677 | (1250) | 144.1 | 600 |
| 13 | 701 | (1295) | 140.9 | 600 |
| 3 | 704 | (1300) | 139.7 | 600 |
| *12 | 704 | (1300) | 139.7 | 600 |
| 1 | 732 | (1350) | 133.6 | 600 |

*These tubes were evaluated by room temperature tensile tests and optical microscopy.

TABLE VI

Room Temperature Tensile Properties of Induction Annealed Zircaloy-4 Cladding

| Tube | Temperature (°F.) | YS (ksi) | UTS (ksi) | Elong. (%) | Metallurgical Condition |
|---|---|---|---|---|---|
| As-pilgered (4377) | — | 125.8 | 132.0 | — | CW |
| | Lot 4377 (~80 inches/minute) | | | | |
| 3 | 1100 | 95.7 | 123.0 | 15.0 | SRA |
| 4 | 1170 | 92.6 | 121.4 | 16.5 | SRA |
| 2 | 1200 | 91.8 | 120.7 | 18.0 | SRA |
| | Lot M5595 (~160 inches/minute) | | | | |
| 24-1 | — | — | — | — | — |
| 24-2 | 1045 | 98.0 | 123.9 | 13.0 | SRA |
| 24-3 | 1045 | 98.8 | 124.1 | 15.5 | SRA |
| 9-1 | 1105 | 95.8 | 122.7 | 16.0 | SRA |
| 9-2 | 1105 | 95.6 | 122.3 | 13.5 | SRA |
| 9-3 | 1105 | 95.6 | 122.7 | 16.0 | SRA |
| 6-1 | 1125 | 95.0 | 122.3 | 16.0 | SRA |
| 6-2 | 1125 | 94.6 | 122.4 | 13.5 | SRA |
| 6-3 | 1125 | 94.4 | 122.7 | 16.0 | SRA |
| 16-1 | 1175 | 92.0 | 121.5 | 15.0 | SRA |
| 16-2 | 1175 | 91.6 | 120.7 | 13.5 | SRA |
| 16-3 | 1175 | 92.4 | 121.5 | 16.5 | SRA |
| 4-1 | 1205 | 91.0 | 120.0 | 17.5 | SRA |
| 4-2 | 1205 | 89.5 | 118.2 | 15.0 | SRA |
| 4-3 | 1205 | 90.6 | 120.0 | 17.5 | SRA |
| 8-1 | 1250 | 85.3 | 113.5 | 14.0 | PRA |
| 8-2 | 1250 | 86.9 | 116.3 | 17.0 | PRA |
| 8-3 | — | — | — | — | — |
| 12-1 | 1300 | 70.3 | 94.0 | 29.5 | PRA |
| 12-2 | 1300 | 69.7 | 93.2 | 20.5 | PRA |
| 12-3 | 1300 | 71.7 | 96.4 | 23.0 | PRA |

NOTE:
1. Examination of the temperature charts for tubes 24 and 8 revealed that tensile samples 24-1 and 8-3 were not sectioned from regions characteristic of induction annealed cladding.
2. Tensile testing shown in Tables VI and IX performed in accordance with ASTM E-8. A 2" gauge length was used with a cross head speed 0.005 inch/inch/minute up to yielding with a cross head speed of 0.050 inch/inch/minute there-after.
3. SRA = stress relief annealed; PRA = partial recrystallization annealed.

TABLE VII

Zircaloy-4 Ingot Chemistry*

| | Lot M5595 | Lot 4377 | Lot 6082 |
|---|---|---|---|
| Sn | 1.51–1.54 w/o | 1.41–1.60 w/o | 1.54–1.57 w/o |
| Fe | 0.21–0.22 w/o | 0.19–0.22 w/o | 0.21–0.22 w/o |
| Cr | 0.10–0.11 w/o | 0.09–0.11 w/o | 0.11 w/o |
| C | 0.010–0.014 w/o | 0.010–0.016 w/o | 0.011–0.012 w/o |
| O | 0.13–0.14 (.128–.131) w/o | 0.12–0.13 (.118–.12) w/o | 0.12–0.13 w/o |
| Al | 60–64 | 61–73 | 45–51 |
| B | <0.25 | <0.25–0.30 | <0.25–0.3 |
| Cd | <0.25 | <.25 | <0.25 |
| Cl | <5 | <5 | <5 |
| Co | <10 | <10 | <10 |
| Cu | <25 | <10–15 | <25 |
| Hf | 46–58 | 43–49 | 48 –51 |
| H | <5–23 (<5) | <5 (<5–6) | <5–15 (<5–7) |
| Pb | <25 | <25 | <25 |
| Mg | <10 | <10 | <10 |
| Mn | <25 | <25 | <25 |
| Mo | <10 | <10 | <10 |
| Ni | <35 | <35 | <35–39 |
| Nb | <50 | <50 | <50 |
| N | 25–35 (22–29) | 29–46 (22–28) | 31–45 (29–33) |
| Si | 89–105 | 82–93 | 0.008–0.0097 w/o |
| Ta | <100 | <100 | <100 |
| Ti | <25 | <25 | <25 |
| W | <50 | <50 | <50 |
| U | <1.0 | <1.0 | <1.0 |
| V | <25 | <25 | <25 |
| U-235 | <0.01 | <0.01 | — |

*All alloy elements are reported in weight percent (w/o). Impurities are reported in ppm.

A third lot of Zircaloy-4 as cold pilgered final size fuel cladding (Lot 6082, see Table VII) was induction final annealed.

In this set of examples fourteen as-pilgered tubes were induction annealed at a nominal production rate of 600 inches/minute using the coil and frequency shown in the third column of Table III. A summary of the induction annealing parameters is provided in Table VIII to either stress relief anneal or partial recrystallization anneal the tubes.

Figure 3:
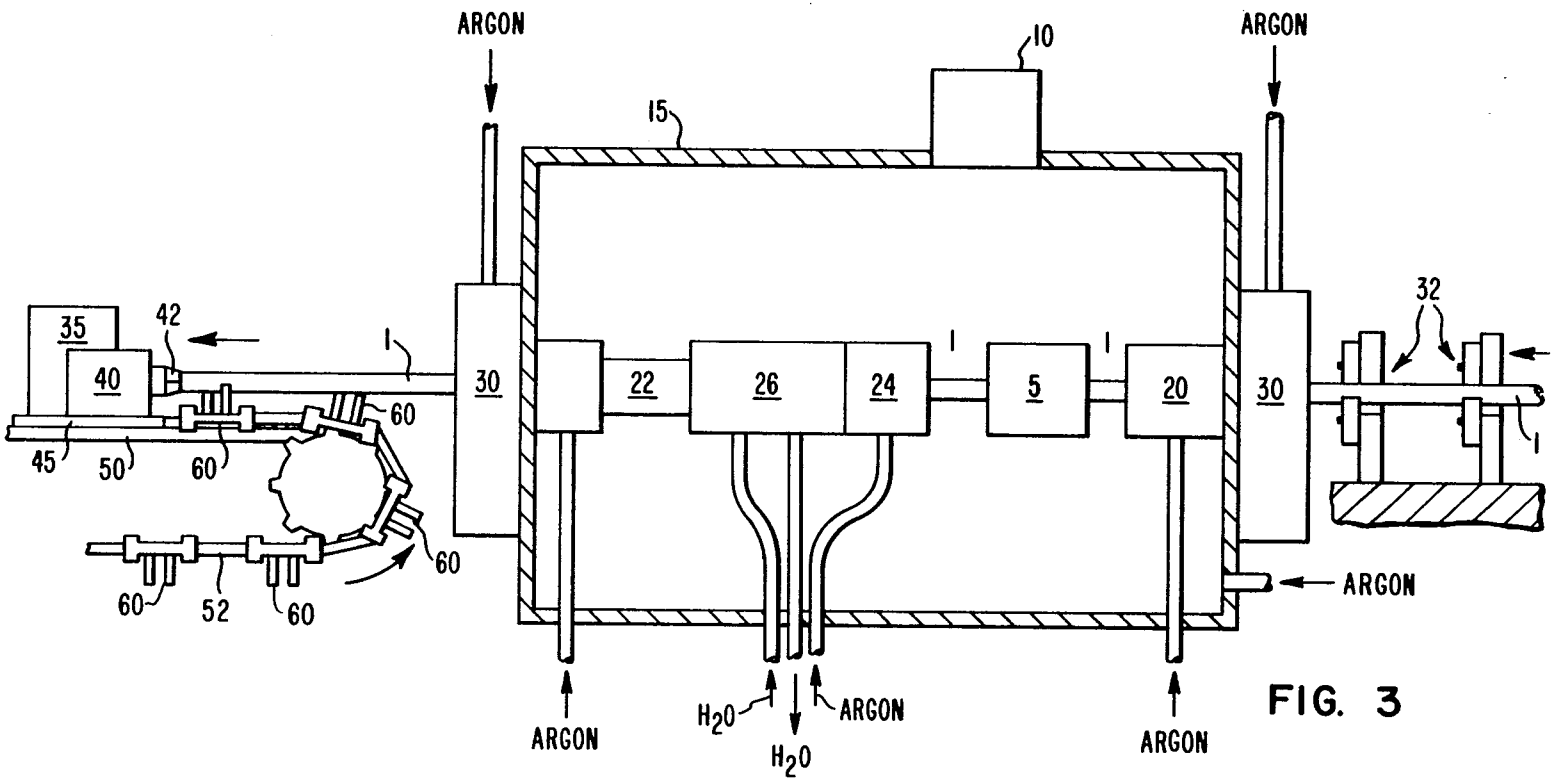
FIG. 3 shows a schematic view of an embodiment of an apparatus used to perform induction alpha anneals in accordance with the present invention.

Tubes were annealed in sequential order using a system similar to that shown in FIG. 3. An IRCON (G Series) pyrometer was used to monitor tube temperature. The reported temperatures correspond to an emissivity setting of 0.29 on the pyrometer. All anneals were performed in an argon atmosphere.

After annealing, all tubes may be ultrasonically inspected and receive conventional final finishing operations. Tensile properties of the induction annealed tubes are shown in Table IX.

TABLE VIII

Induction Annealing Parameters (0.374 inch OD × 0.023 inch wall)

| Tube | Nominal Temperature °C. | (°F.) | Speed (inches/minute) | RPM |
|---|---|---|---|---|
| 6-2 | 704 | (1300) | 530 | 1100 |
| 6-3 | 704 | (1300) | 536 | 1100 |
| 6-4 | 704 | (1300) | — | 1100 |
| 6-5 | 677 | (1250) | 551 | 1200 |
| 6-6 | 616 | (1140) | 594 | 1200 |
| 6-7 | 643 | (1190) | 574 | 1200 |
| 6-8 | 599 | (1110) | 619 | 1200 |
| 6-9 | 579 | (1075) | 640 | 1200 |
| 6-10 | 693 | (1280) | 540 | 1200 |
| 6-11 | 610 | (1130) | 610 | 1200 |
| 6-12 | 634 | (1175) | 588 | 1200 |
| 6-13 | 624 | (1155) | 581 | 1200 |
| 6-14 | 710 | (1310) | 526 | 1200 |
| 6-15 | 566 | (1050) | 660 | 1200 |

TABLE IX

| Tube | Temperature °C. | (°F.) | YS (ksi) | UTS (ksi) | Elong. (%) | Metallurgical Condition |
|---|---|---|---|---|---|---|

A. Room Temperature Tensile Properties of Induction Annealed Zircaloy-4 Cladding TABLE IX-continued

| Tube | Temperature °C. | Temperature (°F.) | YS (ksi) | UTS (ksi) | Elong. (%) | Metallurgical Condition |
|---|---|---|---|---|---|---|
| | | | Lot 6082 | | | |
| 6-15 | 566 | (1050) | 97.1 | 122.2 | 14.5 | SRA |
| | | | 98.4 | 122.8 | 14.5 | |
| 6-8 | 599 | (1110) | 94.2 | 120.8 | 15.0 | SRA |
| | | | 94.7 | 121.0 | 15.5 | |
| 6-13 | 624 | (1155) | 92.8 | 121.2 | 16.5 | SRA |
| | | | 93.1 | 120.9 | 15.5 | |
| 6-7 | 643 | (1190) | 90.7 | 119.1 | 16.0 | SRA |
| | | | 91.1 | 119.5 | 16.5 | |
| 6-5 | 677 | (1250) | 87.4 | 117.2 | 17.0 | SRA/PRA |
| | | | 87.8 | 117.0 | 16.5 | |
| | | | B. 725° F. Tensile Properties | | | |
| 6-15 | 566 | (1050) | 57.5 | 68.1 | 18.5 | SRA |
| 6-8 | 599 | (1110) | 56.3 | 68.1 | 16.0 | SRA |
| 6-13 | 624 | (1155) | 56.1 | 68.5 | 18.5 | SRA |
| 6-7 | 643 | (1190) | 55.2 | 68.1 | 18.0 | SRA |
| 6-5 | 677 | (1250) | 54.0 | 67.4 | 18.0 | SRA/PRA |

The proceeding examples have been directed to stress relief and partial recrystallization induction anneals. The following examples are directed to full recrystallization anneals.

Conventional fabrication of Zircaloy-4 tubing, for example, includes cold pilgering to nominally 1.25 inch OD×0.2 inch wall whereupon it receives a conventional vacuum intermediate anneal at roughly 1250° F. for roughly 3.5 hours. This vacuum anneal results in a recrystallized grain structure having an average ASTM grain size number of 7 or finer, typically about ASTM No. 11 to 12. This material is then cold pilgered to nominally 0.70 inch OD by 0.07 inch wall. At this point the material usually receives another vacuum intermediate anneal. We however replaced this vacuum anneal with an induction fully recrystallization anneal in accordance with our invention. The cold pilgered tubes were induction annealed in a system similar to that shown in FIG. 3 with modifications made where needed to accept the larger OD tubing. Induction heating was done at a frequency of 10 kHz. The coil used was a six-turn coil of ¼ inch by ½ inch rectangular tubing (½ inch dimension along coil radius). The coil had a 1½ inch ID, a 2½ inch OD and a length of about 3.25 inches. Full recrystallization anneals were achieved using the two sets of process parameters shown in Table X. The fabrication of the tubes may then be essentially completed by cold pilgering followed by a conventional vacuum final anneal, or more preferably an induction final anneal in accordance with the present invention. It is also contemplated that additional intermediate vacuum anneals may be replaced by induction anneals in accordance with the present invention. In fact, it is contemplated that all vacuum anneals may be replaced by induction anneals.

TABLE X

Full Recrystallization Induction Annealing Parameters for Intermediate Size (0.7 inch OD × 0.07 inch Wall) Tubing

| Tube | Nominal Temperature °C. | Nominal Temperature (°F.) | Speed (inches/minute) | RPM |
|---|---|---|---|---|
| 9-7 | 871 | (1600) | 54.8 | 500 |
| 9-2 | 816 | (1500) | 60.0 | 500 |
| 9-9 | 760 | (1400) | 65.0 | 500 |

In the final set of detailed examples, as-pilgered Zircaloy-4 tubing (Lot 4690—1.25 inch OD×0.2 inch wall; see Table XV for chemistry) were beta treated by induction heating utilizing a system similar to that shown in FIG. 3. In this case the coil used was a five-turn coil made of rectangular ¼ inch×½ inch tubing (½ inch dimension along radius). The coil had a 2 inch ID and a 3 inch OD, and was about 2⅝ inches in length. This coil was connected to a 10 kHz generator having a maximum power rating of 150 KW. The argon purge tubes and water-cooled cooling tube were replaced by a water spray quench ring. The quench ring had ten holes spaced uniformly around its ID (inside diameter) circumference and caused water, at a flow rate of 2 gallons/minute, to impinge the surface of the heated tube at a distance of approximately 3.3 inches after the tube exited the induction coil. It was roughly estimated that this quenching arrangement produced a quench rate of about 900° to 1000° C. per second.

In addition to the second guide tube 22 was removed and replaced by placing the exit side adjustable chuck 30 within the chamber. Utilizing this system, three intermediate size tubes were beta treated using the parameters shown in Table XI.

TABLE XI

Induction Beta Treating Parameters

| Tube | Nominal Temp. Upon Exiting Coil °C. | Nominal Temp. Upon Exiting Coil (°F.) | Speed (inches/minute) | Time at High Temperature (sec)* | RPM |
|---|---|---|---|---|---|
| 7 | 1082 | (1980) | 17.1 | 11.6 | 750 |
| 8 | 1099 | (2010) | 17.1 | 11.6 | 820 |
| 8A | 1038 | (1900) | 18.0 | 11.0 | 820 |

*Time between exiting coil and impingement of water quench

These beta treated tubes were subsequently cold pilgered to 0.7 inch OD×0.07 inch wall whereupon some of the tubes were induction recrystallization annealed utilizing the equipment we have previously described in our induction intermediate annealing examples. The annealing parameters utilized here are shown in Table XII.

TABLE XII

Intermediate Recrystallization Anneal After Beta Treatment and Cold Pilgering

| Tube | Nominal Temperature °C. | Nominal Temperature (°F.) | Speed (inches/minute) | RPM |
|---|---|---|---|---|
| 7-2 | 838 | (1540) | 54.1 | 700 |
| 7-3 | 871 | (1600) | 54.5 | 700 |
| 7-4 | 793 | (1460) | 57.4 | 700 |
| 8-1 | 899 | (1650) | 47.6 | 700 |
| 8A-1 | 760 | (1400) | 60.8 | 700 |
| 8A-4 | 860 | (1580) | 50.9 | 700 |

The tubes were then cold pilgered to final size fuel cladding (0.374 inch OD×0.023 inch wall). These tubes may then be stress relieved, partially recrystallized or fully recrystallized, preferably via induction annealing techniques in accordance with the present invention.

Samples of this material were given a final vacuum stress relief anneal (at about 870° F. for about 7.5–9.5 hours). The 500° C., 1500 psi, 24 hour corrosion properties of these material are shown in Table XIII. All samples exhibited essentially black continuous oxide films (i.e. no nodules on major surfaces) after testing.

TABLE XIII

| 500° C. Corrosion Weight Gains | | | |
|---|---|---|---|
| | Intermediate | Weight Gain | |
| Tube | Anneal Temp. | Pickled | Polished |
| 7-2 | 1540° F. | 73.1 | 113.8 |
| | (838° C.) | 64.7 | 109.6 |
| 7-3 | 1600° F. | 63.3 | 114.2 |
| | (871° C.) | 65.0 | 123.9 |
| 7-4 | 1460° F. | 60.5 | 88.1 |
| | (793° C.) | 60.3 | 85.2 |
| 8-1 | 1650° F. | 71.4 | 116.2 |
| | (898° C.) | 71.5 | 112.5 |
| 8A-1 | 1400° F. | 64.0 | 103.5 |
| | (760° C.) | 62.6 | 98.0 |
| 8A-4 | 1580° F. | 71.4 | 132.6 |
| | (860° C.) | 68.1 | 126.9 |

In a similar manner an intermediate size tube (1.12 inch OD×0.62 ID) of Zircaloy-2 was beta treated, cold pilgered, induction annealed in accordance with the present invention at about 1560° F. (0.67 inch OD×0.1 inch wall), cold pilgered to final size and then vacuum stress relief annealed (final size=0.482 inch OD×0.418 inch ID). Samples of this material were then corrosion tested in 500° C., 1500 psi steam for 24 hours. Post test examination indicated that all specimens exhibited an essentially black continuous oxide film on their major surfaces. The resulting weight gains are shown in Table XIV.

TABLE XIV

| Zircaloy-2 Corrosion Test Results | |
|---|---|
| Sample Condition | Wt. Gain mg/dm$^2$ |
| Pickled | 61.1 |
| Pickled | 65.5 |
| As Polished | 108.6 |
| As Polished | 111.2 |

It is believed that the use of induction anneals in accordance with our invention, after beta treatment as intermediate and/or final anneals, results in less coarsening of precipitates than that observed when conventional vacuum anneals are utilized after beta treatment. It is therefore expected that the corrosion properties of Zircaloy can be improved by substituting our induction anneals for the conventional vacuum anneals after beta treatment.

TABLE XV

| Ingot Chemistry | |
|---|---|
| Sn | 1.47–1.56 w/o |
| Fe | .20–.23 w/o |
| Cr | .10–.12 w/o |
| C | 0.014–0.0190 w/o |
| Al | 43–46 ppm |
| B | <0.2 |
| Cd | <0.2 |
| Cl | <10–20 |
| Co | <10 |
| Cu | <25 |
| Hf | 53–57 |
| Pb | <50 |
| Mn | <25 |
| Mg | <10 |
| Mo | <25 |
| Ni | <25 |
| Nb | <50 |
| Si | 69–79 |
| Ta | <100 |
| Ti | <25 |
| W | <50 |
| V | <25 |
| U | 2.5–2.7 |
| H | (<12) |

TABLE XV-continued

| Ingot Chemistry | |
|---|---|
| N | (31–36) |
| O | (.13–.14 w/o) |

Alloying elements reported in weight percent, all impurities are in ppm. Range of values indicate the range in test results obtained from various ingot locations. Values in parenthesis were determined on the tube shell.

It is contemplated that in order to reduce prior beta grain size in the proceeding examples that the time at the beta treatment temperature should be reduced. This goal may be accomplished, for example, by moving the quench ring closer to the end of the induction coil and/or increasing the translational speed of the tube. It is therefore believed that the tube should be quenched within 2 seconds, and more preferably within 1 second, of exiting the induction coil. It is also contemplated that the through wall beta treatment may be replaced by a partial wall beta treatment. It is further contemplated that the beta treatment, while preferably done at least a plurality of cold pilger steps away from final size, may also be performed immediately prior to the last cold pilger pass.

The preceding discussion and examples have described the present invention as it is applied to cold pilgered Zircaloy tubing. Those of ordinary skill in the art will recognize that the annealing parameters in accordance with the present invention can be affected by the microstructure of the Zircaloy prior to cold pilgering and by precipitation hardening reactions occurring concurrently with the annealing processes described herein. It should also be recognized that the annealing parameters described herein can be affected by the exact composition of the material to be treated. It is now contemplated that the processes according to the present invention, can be applied to Zirconium and Zirconium alloy tubing, other than Zircaloy-2 and 4, with appropriate modifications due to differences in the annealing kinetic of these materials. It is specifically contemplated that our invention may be applied to Zircaloy tubing having a layer of Zirconium or other pellet cladding interaction resistant material bonded to its internal surface. It is expected that in this last application that induction annealing will result in improved control of the grain size of the liner, as well as improved ability to reproducibly produce a fully recrystallized linear bonded to a stress relieved or partially recrystallized Zircaloy.

It is further believed that the tubes produced in accordance with the present invention will have improved ovality compared to tubes annealed in a batch vacuum annealing furnace, in which the weight of the tubes lying on top of each other at the elevated annealing temperatures can cause the tubes to deviate from the desired round cross section.

In the foregoing detailed examples only a portion of the length of each tube can be induction annealed due to limitations in our experimental equipment. It is expected that those of ordinary skill in the art, based on the description provided herein, will be able to construct equipment capable of induction annealing essentially the entire length of each tube.

The preceding examples have clearly demonstrated the benefits obtainable through the practice of the present invention. Other embodiments of the invention will become more apparent to those skilled in the art from a consideration of the specification or actual practice of the invention disclosed herein. It is intended that the specification and examples be considered as exemplary only, with the true scope and spirit of the invention being indicated by the following claims. All of the documents previously cited herein are hereby incorporated by reference.

We claim:

1. A process for alpha annealing of about 70% to about 85% cold worked Zircaloy tubing comprising the steps of:

rapidly heating said cold worked Zircaloy to a temperature between about 540° and about 900° C. at a rate in excess of 800° F. per second using a scanning induction heating coil;

maintaining said temperature for less than about 1 second;

and then cooling said Zircaloy at a rate between about 5° to 100° F. per second as said Zircaloy exits said coil, thereby better controlling the microstructural changes by causing the changes to occur predominantly during cooling.

2. A process for alpha annealing about 70% to about 85% cold worked Zircaloy tubing comprising the steps of:

rapidly heating said cold worked Zircaloy to a temperature between about 540° and about 900° C. at a rate in excess of 3000° F. per second using a scanning induction heating coil;

maintaining said temperature for less than about 1 second;

and then cooling said Zircaloy at a rate above about 5° per second but less than 1/10 the heating rate as said Zircaloy exits said coil to cause microstructural changes to occur predominantly during cooling.

3. A process for alpha annealing about 70% to about 85% cold worked Zircaloy tubing comprising the steps of:

rapidly heating said cold worked Zircaloy to a temperature between about 540° and about 900° C. at a rate in excess of 800° F. per second using a scanning induction heating coil;

maintaining said temperature for less than 1 second;

and then cooling said Zircaloy at a rate between about 5° to 100° F. per second as said Zircaloy exits said coil.

4. A process for stress relief annealing of Zircaloy tubing comprising the steps of:

scanning a tube of as cold pilgered Zircaloy with an energized induction coil to rapidly heat said tube at a rate in excess of 800° F. per second to a maximum temperature, $T_1$, at a heat up rate, a;

maintaining said temperature for less than 1 second;

upon exiting the coil immediately cooling said tube at a cooling rate, $|b|$ to at least about $T_1-75°$ C.;

controlling $T_1$ and $|b|$ to satisfy the following conditions:

$$\sqrt{\frac{.01}{.99}} > \frac{153.1K}{|b|}[\log_e(Ao/A)]^2 e^{-41842/T1};$$

and where Ao/A is between about 2 and 6.7, and where $a \geqq 10\ |b|$.

5. A process for recrystallization annealing of Zircaloy tubing comprising the steps of:

scanning a tube of a cold pilgered Zircaloy with an energized induction coil to rapidly heat said tube at a rate in excess of 800° F. per second to a maximum temperature $T_1$ at a heat up rate, a;

maintaining said temperature for less than 1 second;

upon exiting said coil immediately cooling sid tube at a cooling rate, $|b|$ to at least $T_1-75°$ C.;

controlling $T_1$ and $|b|$ to satisfy the following conditions:

$$\sqrt{\frac{.01}{.99}} < \frac{153.1K}{|b|}[\log_e(Ao/A)]^2 e^{-41842/T1};$$

and where Ao/A is between about 2 and about 6.7, and where $a \geqq 10|b|$.

6. The process according to claim 5 wherein said process results in a partially recrystallized microstructure by controlling the process to satisfy the following additional condition:

$$\frac{153.1K}{|b|}[\log_e(Ao/A)]^2 e^{-41842/T1} \lesssim \sqrt{\frac{.95}{.05}}.$$

7. The process according to claim 5 wherein said process results in a fully recrystallized microstructure by controlling the process to satisfy the following additional condition:

$$\sqrt{\frac{.95}{.05}} < \frac{153.1K}{|b|}[\log_e(Ao/A)]^2 e^{-41842/T1}.$$

* * * * *